United States Patent [19]

Holt

[11] Patent Number: 4,489,679

[45] Date of Patent: Dec. 25, 1984

[54] CONTROL SYSTEM FOR ECONOMIC OPERATION OF A STEAM GENERATOR

[75] Inventor: Fletcher O. Holt, Tulsa, Okla.

[73] Assignee: Combustion Engineering, Inc., Windsor, Conn.

[21] Appl. No.: 560,463

[22] Filed: Dec. 12, 1983

[51] Int. Cl.[3] ..... F22D 5/00

[52] U.S. Cl. ..... 122/451 S; 110/186; 110/215; 122/412; 122/420; 122/421; 122/451.2; 236/14

[58] Field of Search ..... 122/451.1, 451 S, 412, 122/420, 421, 448 S, 451 R; 236/14; 431/12, 76; 110/185, 186, 188, 215, 216

[56] References Cited

U.S. PATENT DOCUMENTS

| | | | |
|---|---|---|---|
| 3,205,870 | 9/1965 | Durham et al. | 236/14 |
| 3,693,557 | 9/1972 | Makuch | 110/186 |
| 3,774,396 | 11/1973 | Borsi et al. | 122/448 |
| 4,031,863 | 6/1977 | Laubli | 236/14 |
| 4,241,701 | 12/1980 | Morse | 236/14 |
| 4,318,366 | 3/1982 | Tompkins | 122/412 |
| 4,418,651 | 12/1983 | Wyatt | 122/412 |

*Primary Examiner*—Edward G. Favors
*Assistant Examiner*—Steven E. Warner
*Attorney, Agent, or Firm*—Arthur L. Wade

[57] ABSTRACT

A once-through steam generator has both radiant and convection sections. The flue gases discharged from the convection section are passed through a wet scrubber to remove both sulfur oxides ($SO_x$) and particulate matter. The feedwater to the convection section has its temperature controlled by the temperature of the flue gases discharged from the convection section, reducing the temperature of the feedwater by the use of a feedwater exchanger, as the convection section progressively fouls due to particulates in the flue gases. An additional heat exchanger upstream of the feedwater exchanger and convection section which scavenges additional heat from the wet scrubber liquids while the temperature of the flue gases into the scrubber are lowered to a temperature equal to or less than the water dew point temperature of the flue gases entering the scrubber.

3 Claims, 1 Drawing Figure

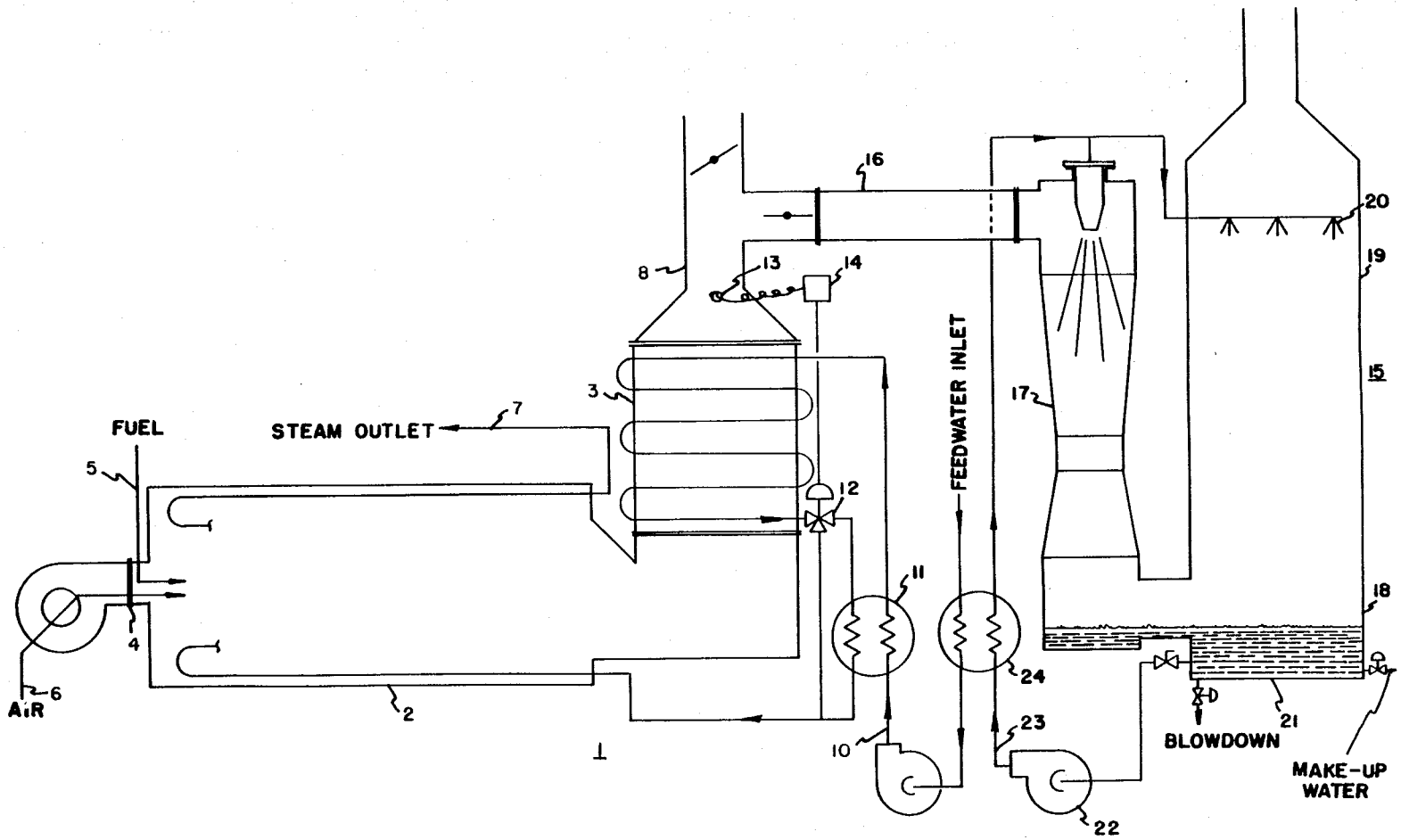
MAKE-UP WATER
BLOWDOWN
FEEDWATER INLET
STEAM OUTLET
FUEL
AIR
1
2
3
4
5
6
7
8
10
11
12
13
14
15
16
17
18
19
20
21
22
23
24

CONTROL SYSTEM FOR ECONOMIC OPERATION OF A STEAM GENERATOR

TECHNICAL FIELD

The present invention relates to controlling the efficiency of a steam generator while maintaining a constant steam quality output. More particularly, the invention relates to controlling a steam generator operation to lengthen the present cycle before convection surface cleaning is required, while maintaining maximum efficient operation.

BACKGROUND ART

The gas or oil-fired, once-through steam generator has been developed over the past 20 years for secondary recovery in the oil fields. In configuration, these generators have a horizontal elongated radiant section into which burners discharge products of combustion. The products of combustion, as flue gases and entrained particulates, flow through a convection section, and discharge to the atmosphere. All the contaminants of these flue gases are of concern to governmental regulatory agencies. Wet scrubbers have recently been developed to remove the entrained particulates and sulfur oxides ($SO_x$).

Typically, most steam generators for these applications are designed to produce a steam quality effluent of 80%—i.e., 80% by weight vapor and 20% by weight liquid leaving the unit. Flue gas temperatures leaving the convection section are in the range of 450° F. when utilizing a feedwater preheated to 250° F. With these temperatures, a gross thermal efficiency of approximately 85% is expected when the generator is oil-fired, with 20% excess combustion air and with all surfaces cleaned and performing to design conditions. Assuming a reasonable setting loss of 2 to 3%, the gross overall efficiency is realistically about 82%. Input rates (fuel, water, and air) are usually held constant and during operation the convection section surfaces become fouled, thus reducing heat transfer efficiency. Consequently, the flue gas temperature exiting the convection section increases from 450° F. to about 750° F. before the unit is shut down and the surfaces of the convection section cleaned. With all other variables held constant, this increase in stack temperatures from 450° F. to 750° F. results in a drop in gross thermal efficiency from 85% to approximately 77%. Subtracting for setting losses, the gross overall efficiency drops from 82% to 74%, or a 10% drop in output capacity. The end result is that usually the quality of the outlet steam reduces from 80% to approximately 64%. This reduction in steam quality reduces the total heat content per pound of steam leaving the generator to be injected into the well. Additional increases in oil well production costs are experienced as a result of the reduction in steam quality.

The feedwater rate could be reduced to maintain a constant efficiency at reduced outputs if desired, but this is usually not the case since it is time consuming and must be continuously changed to keep operating factors or variables in balance. An operator usually oversees several steam generators and has only a limited time available to "tune" or "adjust" the units.

The duration of the operating cycle from a clean surface area condition to a fouled surface area condition depends on many variables such as cleanness of fuel burned, how well liquid fuel is atomized and burned, contaminants in the fuel, design of convection sections, etc. A typical cycle length could be from one month to four months, with six weeks to two months being an average cycle length. The fouling may not necessarily be linear with time. Sometimes the fouling accelerates early in the cycle and tends to level out late in the cycle. At other times the fouling is slow at the beginning of the cycle, but accelerates late in the cycle when the surface area plugs, as well as fouls, creating excessive pressure drop, causing the air fan capacity to reduce toward substoichiometric combustion. In these instances, both fouling and plugging can cause cycle lengths to be reduced to a matter of hours, or even minutes.

The era of cheap energy is over. The inefficient operation of the typical steam generator in the oil fields can no longer be tolerated. With a typical 50 MM btu per hour steam generator, installed at a cost of less than ½ million dollars, the fuel cost alone can be more than $2 million annually. Given the many years of expected life of these units, a tremendous opportunity to exploit systems to increase the efficiency of these units is evident.

Recently admirable efforts have produced sub-dew point convection sections as add-ons to present convection sections. As these sub-dew point convection sections have reduced the temperature of the flue gases to the range of 220° F. to 280° F. (the dew point of sulfuric acid gases) acid-resistent materials and arrangements have been introduced to ensure satisfactory service life.

For the present disclosure, it will be assumed that the convection section, including a sub-dew point section, is mounted on the end of the radiant section of the steam generator. All subsequent analysis assumes that the convection section has the surface area necessary to reduce the flue gas temperature to the 220° F. to 280° F. sulfuric acid gas condensation range. If the flue gas temperature out of this convection section can be maintained constant by adjustment of the feedwater temperature to the convection section as the section fouls, the time between surface cleaning will be lengthened while the efficiency of operation will be maintained. Additionally, if the selected temperature for the flue gas can be maintained low enough to prevent or minimize subsequent scrubbing liquids from vaporizing or reaching their vaporization temperature, the major portion of the heat contained in the flue gas leaving the convection section can be recovered in the scrubber from the sensible heat of the scrubbing liquid and exchanged or transfered to the feedwater, providing the feedwater can be supplied at a sufficiently low temperature.

The removal of sulfur oxides from the flue gases in a wet scrubber is both a physical and a chemical process. As the sulfur oxides, physically absorbed and held in solution in the recirculating scrubbing water, are removed from the flue gas, the scrubbing water becomes more acidic—i.e., the pH reduces. Chemicals which have high alkalinities (basic), such as sodium hydroxide (NaOH-caustic) or sodium carbonate ($Na_2CO_3$-soda ash) or ammonia ($HN_3$) are added to the scrubber liquid to neutralize the reaction and hold near to neutral (pH=7) solution to minimize corrosion problems. As a practical matter, the solution is held slightly acidic (less than pH=7) to enable the chemicals to react more efficiently. As the sulfur oxides ($SO_x$) react chemically with the alkalinity bases, salts are formed which, if allowed to concentrate in the scrubbing liquid, would eventually precipitate from the water.

Scrubbing water is provided a closed loop within the scrubber. That is, the same water is cycled over and over again to contact the flue gases. A recirculation pump takes its suction from the reservoir of scrubbing water and pumps it to either the spray nozzles or to the venturi eductor, or both (which ever is utilized), where initial contact is made between the hot flue gas and the circulating water. The scrub water eventually gravitates to the scrubber reservoir for recirculation. The closed loop water circulation system does not contain any external cooling device. Upon initial start up, the water in the closed loop begins to heat up by contact with the hot flue gas. Eventually, the temperature of the water stabilizes at a temperature somewhere between 140° F. and 160° F. (dependent on flue gas temperature and its own water content). At the stabilized water temperature, the scrubber is said to be at equilibrium temperature. When some of the water coming in contact with the hot flue gas is evaporated, it will leave the scrubber as steam vapor. This water vapor becomes part of the flue gas volume, increasing its water vapor content and partial pressure. For the scrubber to be in equilibrium, the following two (2) conditions must exist:

(1) The partial pressure of the water vapor contained in the flue gas leaving the flue gas scrubber must equal the vapor pressure of the scrubber water at the operating conditions; and (2) The duty required to cool the flue gas from its entering temperature to its exiting temperature must equal to the product of the water vaporized from the cooling circuit times its latent heat of vaporization at the operating temperature.

Once the scrubber comes up to equilibrium temperature, all further cooling provided by the scrubber on the flue gas is latent heat of vaporization. Water makeup is, therefore, required to maintain inventory of water in the closed loop. Also, the scrubber liquid must be periodically partially removed by blow down to prevent the buildup of solid concentration. Therefore, the total makeup water is the sum of the vaporization load plus the blow down load. Since the makeup water is usually treated water, the cost can become significant. Makeup water rates can be 5% to 10% of steam generator feedwater rate.

If the blow down rate is held to a minimum, or if a scrubber liquid makeup contains a lot of total dissolved solids, the entire scrubber inventory contains a high amount of T.D.S. With a scrubber providing the cooling requirement of the flue gas entirely with latent heat of vaporization within the recirculation water, a considerable amount of total dissolved solids will be flash-dried when contacted with the hot flue gas. These aerosol-type solids are submicron in size and difficult to separate from the flue gas vapors. The solids are even difficult to separate or redissolve in the water stream in the event a second stage contact is utilized, due to the short contact time and unfavorable equilibrium conditions. They are usually carried out with the flue gas vapors and are considered particulate matter. Thus, the scrubber removes particulate matter of one nature from the steam generator, but in the process adds back particulates of a different nature to the flue gas.

With the brief description given as to how most steam generators are currently being operated throughout a cycle, and with a brief description of how wet flue gas scrubbers are currently being operated, present generator and scrubber operation can be summarized as follows:

(1) Current oil-fired steam generators operate in the range of 82% high, down to 74% low gross overall efficiencies, with an average of possibly 78% being typical.

(2) Steam qualities of 80% are not maintained continuously throughout the cycle.

(3) Flue gas scrubbers currently are not recovering any heat from the flue gas off the steam generators.

(4) Considerable makeup water can be required for the wet scrubbers when flue gas temperatures are allowed to rise and remain high.

(5) Particulate emissions from the flue gas scrubbers can be undesirably high.

NEEDS MET BY INVENTION

There is a need for a more efficient method of operation—one that would result in a higher gross efficiency over a longer period of time, thus providing a near constant output in capacity throughout the complete cycle before cleaning of convection surface areas would be required. Reduced fuel costs through waste heat recovery within the scrubber and reduced water costs through reduction in vaporization load within the scrubber are desired. Finally, efficient operation of the steam generator and scrubber should include control of the scrubber to reduce particulate emission caused by vaporization of scrubber water.

DISCLOSURE OF THE INVENTION

The present invention contemplates providing a steam generator convection section with adequate surface area to reduce the temperature of the effluent flue gas to the sulfuric acid gas dew point, and controlling the feedwater temperature to the convection section by the effluent temperature of the flue gas which will maintain the effluent flue gas temperature constant over a significant range of convection surface area fouling.

The invention further contemplates a wet scrubber for the effluent flue gases from the convection section of a steam generator, which would eliminate or minimize the vaporization of the scrubber liquid by maintaining the temperature of the scrubbing liquid inventory close to or less than the water vapor dew point temperature of the effluent flue gas entering the scrubber, and a heat exchanger which would recover the sensible heat from the scrubber liquid and transfer the heat into the feedwater flowing to the convection section.

Other objects, advantages and features of this invention will become apparent to one skilled in the art upon consideration of the written specification, appended claims, and attached drawing.

BRIEF DESIGNATION OF THE DRAWING

The drawing is a schematic of a once-through steam generator and wet scrubber with control systems in which the present invention is embodied.

BEST MODE FOR CARRYING OUT THE INVENTION

Some Generalizations

I have accumulated my knowledge of the construction and operation of the once-through steam generator for secondary recovery over the past 20 years. I have no knowledge of any worker skilled in the art suggesting or implementing continuous control of the flue gas temperature from the convection section of these generators by regulating the temperature of the input to these convection sections. Now, the successful development and experience with the sub-dew point extension of these convection sections has stimulated me to conceive this regulation to maintain a constant temperature for the flue gases. My objective is to maintain this outlet temperature constant at the convection section loses its efficiency due to fouling with solids of the products of combustion. With the control of flue gas temperature over the lengthened period between surface cleaning of the convection section, I conceived that the waste heat could also be salvaged from the products of combustion in a wet-type scrubber. As long as sufficiently cool feedwater is available, the sensible heat in the scrubber liquid can provide salvage through heat exchange between the liquid of the scrubber and the feedwater. Further, salvaging the sensible heat from the scrubber water has brought about the concept of controlling the maximum temperature of the scrubber water which will avoid the loss of particulates from solids in the scrubber water by vaporization of the scrub water. Additionally, controlling the temperature of the scrubber water enables reduction of the flue gas temperature to below the dew point of the water vapor they contain. Thus, the water makeup to the scrubber from an outside source can be reduced, if not eliminated.

As previously indicated in the foregoing "background" section, the present invention uses the combination of the conventional convection section and the sub-dew point convection section as a single tool. In other words, the convection section of the once-through steam generator is designed with the surface area which, when cleaned, can lower the flue gas temperature out of the convection section to the dew point of its acid gases. It is then that the present invention is embodied in the control system which regulates the temperature of the feedwater to the convection section, maintaining a predetermined temperature of the effluent flue gases as the convection section becomes progressively fouled by the solid products of combustion.

EXAMPLES

A typical example is a 50 MM BTU/hr oil-fired steam generator which has a cleaned convection section capable of producing or lowering the effluent flue gas temperature leaving the standard convection section to 350° F. Should a 250° F. outlet temperature from the sub-dew point convection section as desired, a duty requirement of 1,250,000 BTU/hr. on the sub-dew point convection section is required. To operate at this low duty requirement with a sub-dew point convection section containing a large surface area, a log mean temperature difference (LMTD) must be lowered across the sub-dew point convection section. This becomes the controllable variable since the overall heat transfer rate of this section is fixed (if not fouled), and the mass flow rates of water and flue gas are fixed. Therefore, the feedwater heat exchanger duty must be increased to produce an approximate feedwater temperature into the sub-dew point convection section of 225° F. The total feedwater rate is assumed to be 50,000#/hr. and water temperature out of the sub-dew point convection section is 250° F., so the heat duties on both the water and flue gas streams balance.

If the sub-dew point convection section is designed to minimize fouling, or if it has provisions to clean it while in service, it is assumed that it will remain fairly clean or that its cleaning requirement will be a longer time span than the standard convection section. With this being the case, the standard convection section flue gas outlet temperature will then begin to increase during the operation of the steam generator.

Near the last part of a cycle, with fouling occuring such that a 600° F. outlet flue gas temperature from the standard convection section existed, and with still a 250° outlet temperature desired from the sub-dew point convection section, the duty requirement must now increase to 4,250,000 BTU/hr. This is accomplished by reducing the duty on the feedwater exchanger and lowering the feedwater inlet temperature to the sub-dew point convection section from 225° F. to 164° F., thus changing or increasing the LMTD across the sub-dew point convection section to that required to maintain 250° F. outlet flue gas temperature. Finally, if fouling is allowed to continue until the flue gas reaches a temperature of 800° F. out of the standard convection section, the duty requirement of the sub-dew point convection section must now increase to 6,850,000 BTU/hr. to maintain 250° F. out of the sub-dew point convection section, dictating a further reduction in feedwater heat exchanger duty until the feedwater temperature into the sub-dew point convection section is lowered to 111° F. to accomplish this duty.

It is apparent that if the sub-dew point convection section is operated in this mode, it becomes self-compensated in waste heat recovery in order to maintain a constant outlet flue gas temperature. Also, it is apparent that as the duty requirement increases, the feedwater inlet temperature decreases, causing it to operate below the acid dew point temperatures in the flue gases. Therefore, special consideration should be given to the construction of the sub-dew point convection section.

In reality, the sub-dew point convection section will tend to foul to some degree. However, with control of the flue gas outlet temperature, the feedwater inlet temperature will change accordingly to whatever temperature is required to maintain 250° F. outlet flue gas temperature. Whether the standard convection section, or the sub-dew point convection section, fouls first is of no concern. They both could foul together and the duty on the complete steam generator would remain the same as long as the temperature of the flue gas leaving the sub-dew point convection section can be controlled.

HEAT SALVAGE IN WET SCRUBBERS

When a wet flue gas scrubber is utilized downstream of a steam generator, there is an opportunity to recover additional waste heat from the steam generator flue gas. This system is most practical when a feedwater supply is available within a 70° to 90° F. temperature range.

Heat exchangers have been recently developed which yield exceptionally high overall heat transfer coefficients and at the same time essentially eliminate or minimize fouling. They also are constructed to alloys superior to carbon steel in their resistence to corrosion. These new heat exchangers are referred to as "plate type" and provide large surface areas for the exchange of heat between fluids. The design arrangement is so efficient with these new "plate type" exchangers that approach temperatures of 1° F. are feasible. These new plate-type heat exchangers, or equivalent, can easily be incorporated into the present system of generator and flue gas scrubbers. The normal circulation rate within the flue gas scrubber circuit is in the order of 10 to 12 times the circulation rate of the feedwater system in the steam generator circuit, making these exchangers very adaptable to this application. This results in a heat exchanger recovery system which can salvage 2 to 3,000,000 BTU/hr., when cool feedwater is available, for a few thousand dollars investment. Pressure drops are low on both sides of the exchanger. No additional pumps or horsepower is required on either the scrubber circuit, or the feedwater circuit.

One can easily predict the additional heat available to be recovered from a flue gas scrubber by first calculating the equilibrium temperatures at which a scrubber would be operating with various flue gas temperatures entering the scrubber with no external cooling or heat recovery being considered. Secondly, a new equilibrium temperature is calculated at various heat recovery rates. The difference in these temperatures, along with the recirculation rates, determines the amount of temperature rise in the feedwater heat exchanged with the scrub water. A typical example of these equilibrium operating temperatures is approximately 130° F. scrubber operating temperature with 250° F. scrubber inlet flue gas temperature, and 148° F. scrubber operating temperature with 600° F. scrubber inlet flue gas temperature. If 70° F. feedwater is available for cooling and if a plate exchanger, or equivalent, is designed for a 1° F. temperature approach, 2,000,000 BTU/hr. can be recovered by transferring the heat into the 70° F. feedwater with 250° F. flue gas scrubber inlet temperature, and 3,100,000 BTU/hr. can be recovered by transferring the heat into the 70° F. feedwater with 600° F. flue gas scrubber inlet temperatures. Heat recovery from the scrubber amounts to 4% of the total heat output of the steam generator at 250° F. flue gas temperature, and 6% to 7% of the total heat output of the steam generator at 600° F. flue gas temperature. One can see that this type of waste heat recovery system is also partially self-compensating when the convection sections foul, causing increasing flue gas temperatures to the scrubber.

The heat recovery or removal from the flue gas scrubber allows the scrubber to operate at lower temperatures. With 250° F. flue gas temperature into the scrubber and with 70° F. feedwater temperature removing 2,000,000 BTU/hr. from the recirculation circuit, the equilibrium temperature of the scrubber is lowered from 130° F. to 112° F. Thus, the operating temperature of the scrubber is 112° F. with the heat recovery system of the present invention. Water vapor will actually be condensed from the flue gas, this requiring no makeup water for the scrubber for its blow-down requirement. Since water vapor is condensing from the flue gas vapors, there is no latent heat of vaporization requirement on the water being circulated in the scrubber circuit. The entire duty requirement of cooling the flue gas from its 250° F. inlet temperature to its 112° F. exit temperature is recovered as sensible heat within the recirculated water in the scrubber. The heat recovered in the scrubber when exchanged, results in the 70° F. feedwater temperature increasing to 111° F.

Should the flue gas temperature to the scrubber increase to 600° F. and 70° F. water is available to remove 3,100,000 BTU/hr. and transfer to the feedwater, the equilibrium temperature of the scrubber is lowered from 148° F. to 135° F. (with the heat recovery system of the present invention). Since the water vapor dew point of the entering flue gas is still 115° F., there will be no condensing of water vapor from the flue gas stream. In fact, some additional evaporation from the recirculated water must take place. The duty requirement of cooling the flue gas from its 600° F. inlet temperature to its 135° F. outlet temperature is approximately 5,800,000 BTU/hr. However, only part of this duty requirement comes from the sensible heat (3,100,000 BTU/hr.) within the recirculating water. The remainder of the duty requirement must be accomplished by latent heat of vaporization of part of the recirculated water (2,700,000 BTU/hr.). Although there is some vaporization losses and thus some makeup required, it is not as great as it would be as now practiced in the prior art. The 70° F. feedwater is heated to 134° F. as it flows to the feedwater exchanger/sub-dew point convection section, salvaging 3,100,000 BTU/hr. from the scrubber. It is realized that 70° F. feedwater may not always be available for the steam generator; however, as long as there exists a condition where the feedwater temperature is less than the operating temperature of the scrubber, some waste heat may be recovered.

Recovering the waste heat from the scrubber is not limited to exchanging it with the feedwater; however, it is the simplest and most economical way. Waste heat available in the scrubber could be exchanged with the air utilized for combustion, but the end result would not be as efficient or economical. Air combustion rates and feedwater rates are usually similar in mass flow rates. With air having a specific heat of only approximately one-fourth that of water, just one-fourth of the heat could be exchanged to the combustion air. Exchanger surface areas would become larger due to the less favorable overall heat transfer coefficient of air to water, as compared with water to water.

THE DRAWING

In the drawing, the complete once-through steam generator is designated as 1. The components of this generator are indicated as the radiant section 2, and convection section 3. A burner 4 is mounted on the end of the horizontally extended radiant section 2 and is supplied fuel through conduit 5, and the proper amount of combustion air through conduit 6, to sustain a constant combustion discharge into the radiant section.

It is an object of the invention to operate the generator at a constant load. The supplies of fuel and combustion air are represented by conduits 5 and 6. It is to be understood that these supplies of fuel and air come to the burner at a constant predetermined rate.

The heat of combustion is transmitted into feedwater through convection section 3 and radiant section 2. The tubes are divided into various branches and may be finned or bare, according to design. For the purposes of the present disclosure, the feedwater enters the convection section to be heated by the products of combustion and is discharged from the tubes of the radiant section as 80% quality steam. The discharge from the radiant tubes is indicated at 7. The flue gases entrain solid particulate matter which are discharged from convection section 3 at 8. It is an object of the present invention to control the temperature of the flue gases at a constant temperature which is in the temperature range at which the acid gases within the flue gases have their dew point.

It is recognized that convection section 3 has been engineered as having a first part which cools the flue gases down to a level above the dew point of the acid gases, and that a subsequent section is added to further cool the flue gases to the acid gas dew point. For the purposes of the present disclosure, both these sections are regarded as one section 3 from which the flue gases emerge within the acid gas dew point temperature range.

The feedwater brought to the tubes of convection section 3 is supplied through a conduit 10. A first feedwater heat exchanger 11 is in conduit 10 upstream of the tubes of convection section 3. It has been the practice to direct a loop of heated feedwater from convection section 3 tubes back to heat exchanger 11 to establish a satisfactory temperature for the feedwater as it enters the convection section tubes. It has not been the practice in this art to establish a continuous control which will vary the amount of heated feedwater to exchanger 11. Rather, the size of the feedwater heat exchanger 11 has been established and the quantity of the heated feedwater from the convection section has been established to roughly provide a temperature for the feedwater entering the convection section tubes which will, to some extent, cool the flue gases discharged. Subsequent fouling of the convection section heat exchange surfaces would then increase the outlet temperature of the flue gases. It is an object of the present invention to establish control over the rate of flow of heated feedwater to exchanger 11 in accordance with the temperature of the outlet flue gases and, therefore, maintain a constant quality of the steam produced from the radiant section of the generator.

To embody the present invention, valve 12 has been placed in this first system of control, and a temperature-sensing element 13 is disclosed in the flue gas exit of the convection section. A suitable control signal is generated by sensor 13 at station 14 and applied to control valve 12 to maintain a constant temperature of the gases discharged by varying the temperature of the feedwater of conduit 10 entering the tubes of convection section 3.

At this critical point in my disclosure, I wish to emphasize that the control of the feedwater temperature into the convection section is not limited to specifically placing valve 12 in the conduit circulating heated water from the convection section through heat exchanger 11. For example, a bypass valve for the feedwater to heat exchanger 11 would also control the temperature of the feedwater injected into convection section 3. My concept includes regulation of the feedwater temperature to convection section 3 to stabilize the temperature of the flue gases discharged from convection section 3. Valve 12 only represents one arrangement to implement this control within the concept of my invention.

As discussed in the General Considerations, the flue gases entraining solid particulate matter flowed from convection section 3 must have their contaminants reduced to a satisfactory level. A wet scrubber 15 is disclosed as receiving these flue gases at their constant temperature and contacting the gases with scrub water. Wet scrubber 15 may have one or more stages of contact. As an example, the flue gases discharged from the convection section through conduit 16 are initially contacted with scrub water in an eductor-type venturi 17 and directed into a first chamber 18 of scrubber 15. The flow of the flue gases through venturi 17 draws the scrub water into contact with the flue gases and the scrub water and flue gases flow concurrently through the first chamber 18, and then into a second chamber 19. Second chamber 19 may or may not be utilized. Additional scrub water may be supplied in chamber 19 by nozzles 20 into the flowing flue gases and the flow of the flue gases in this second chamber is counter-current to the flow of the scrub water from the nozzles. All scrubbing water gravitates to the bottom reservoir 21 from which a pump 22 takes its suction and recirculates the scrub water in conduit 23 to both the venturi and/or nozzles for further contact with the flue gas stream. A plate-type heat exchanger 24 is connected to indirectly contact the feedwater and the scrub water for heat exchange. Although heat exchanger 24 is described as a plate-type, it is again emphasized that the invention is not limited to the use of this particular type of heat exchanger. The plate-type heat exchanger enjoys enthusiasm because 1° F. approach temperatures can be reached. However, heat exchangers are always under dynamic redesign and the invention is not to be obscured by specifically designating heat exchanger 24 as a plate type.

The second system by which the sensible heat is extracted from the scrub water of scrubber 15 has been generally described previously. With the temperature of the flue gases from the convection section of the generator held at a constant value, and the sensible heat scavenged from the feedwater in the scrubber, both systems operate the steam generator more economically than heretofore. Additionally, the steam delivered from the radiant section is of constant quality. These conditions remain stable until the particulates fouling the heat exchange surface of the convection section become great enough to exceed the range of control exerted by the first system on the feedwater entering the tubes of the convection section. Upon reaching this degree of fouling, the loss of control of the feedwater temperature by the first system is signaled and a surface cleaning operation could be initiated for cleaning the surfaces of convection section 3.

Should a surface cleaning operation not be initiated and the flue gas temperature into the scrubber is allowed to increase, the waste heat recovery system of the scrubber will continue to function. There would be an increase in the heat recovered from the scrubber due to the higher operating temperature of the scrubber. Thus, partial compensation for the decrease in operating efficiency of the convection sections operating with higher flue gas temperature is accomplished.

CONCLUSION

There are at least three features of the present invention which interact with each other to provide a steam generating system. First, for the first time, the present invention regulates the temperature of the feedwater supplied to the convection and radiant sections of the generator to maintain a constant flue gas output temperature while the heat exchange surfaces of the convection section foul with particulate matter. It is desirable and practical to maintain the quality of the steam at 80%, and the regulation of the feedwater temperature maintains this quality as the effectiveness of the heat exchange surfaces of the convection section deteriorates. Once fouling of the heat exchange surfaces reaches the degree at which the temperature of the feedwater can no longer be regulated, a cleaning operation is performed and the cycle repeats.

The first regulating system for the feedwater contains a concept independent of the minimum temperature obtainable for the flue gases discharged from the convection section. However, convection sections have now been developed which make it practical to attain temperatures within the range of acid gas dew point. With the present invention, these sub-dew point convection sections lengthen the cycle of operation between cleaning their heat exchange surfaces. Additionally, with the use of a wet scrubber for the flue gases to remove sulfur oxides ($SO_x$) and particulate matter entrained therein, a secondary benefit is gained.

Prior to the appearance of the sub-dew point convection section, the minimum temperature of the flue gases delivered to the wet scrubber has stabilized the temperature of the scrub water at the value which causes loss of water due to latent heat of vaporization. With dissolved and suspended solids accumulated in the recirculated scrub water, vaporization has resulted in the loss of some of these solids to the discharged flue gases. As observed previously, one solid contaminant will be exchanged for another. Now, with lowered flue gas temperatures to the scrubber, loss of water due to the latent heat of vaporization has been eliminated or minimized and the sensible heat from the scrub water can be salvaged. The third aspect of the invention emerges.

Heat exchangers have now been developed which gain an approach temperature of 1°. Assuming that a source of feedwater has a temperature lower than the temperature of the scrub water, a heat exchanger is provided by the present invention to salvage the sensible heat from the recirculated scrub water into the incoming feedwater. Thus, the cycle is completed.

A constant input of fuel and air to the combustion within the radiant section of the generator can be maintained while the temperature of the feedwater into the convection section is regulated to maintain a constant quality of steam being produced by the generator. The temperature of the flue gases from the convection section is lowered until the latent heat of vaproization of the scrubber water is conserved in the wet scrubbing of the flue gases. The sensible heat of the scrubbing water is salvaged back into the incoming feedwater routed to the convection section.

From the foregoing, it will be seen that this invention is one well adapted to attain all the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A control system for a once-through steam generator which has a radiant section and a convection section with a surface area which enables it to reduce the output flue gas temperature to the dew point of acid gases, including, a burner mounted in the radiant section supplied fuel and air at constant rates and discharging products of combustion into the radiant section from which they flow into and are discharged from the convection section, a constant supply of feedwater connected to the convection section to be heated, a first heat exchanger connected between the feedwater supply and the convection section, a conduit system connecting the first heat exchanger with feedwater heated by the convection section, a first valve in the conduit system which connects the convection section to the first heat exchanger with which to regulate the quantity of water heated by the convection section and passed in heat exchange with the feedwater supplied the convection section, a means sensing the temperature of the flue gases discharged from the convection section to control the first valve and thereby maintain a predetermined temperature for the flue gases discharged from the convection section, a wet scrubber connected to receive the flue gases discharged from the convection section, a supply of water to recirculate in the scrubber to contact the flue gas input to the scrubber and reduce the sulfur oxides ($SO_x$) and solid particulates entrained by the flue gases, and a second heat exchanger connected and arranged to heat exchange the recirculated scrub water with the feedwater supplied the first heat exchanger, whereby the temperature of the flue gas input to the scrubber is limited to such that all the heat available in the flue gases is salvaged as sensible heat from the recirculated scrubber water into the feedwater flowing to the second heat exchanger.

2. The control system of claim 1, wherein, the second heat exchanger is a plate-type with which a substantially 1° F. temperature approach of the exchanged fluids is possible.

3. A system for operating a once-through steam generator which has a radiant section discharging into a convection section from which flue gases discharge into a wet scrubber, including, a first system for supplying fuel and air at predetermined constant rates to a burner for the radiant section, a second system for supplying feedwater at a predetermined constant flow rate to the convection section and the radiant section with which to generate steam of substantially 80% quality, a first heat exchanger mounted in the second system to receive the feedwater flowing into the convection section and feedwater heated by the convection section, a valve connected between the convection section and the first heat exchanger with which to regulate the quantity of heated feedwater from the convection section to the first heat exchanger, a temperature sensor responsive to the heat of the flue gases discharged from the convection section and connected to regulate the valve in the second system to maintain the temperature of the flue gases discharged from the convection section at a predetermined constant value, a reservoir of scrubbing liquid in the wet scrubber controlled to recirculate the liquid in contact with the flue gases discharged from the convection section and reduce the sulfur oxides ($SO_x$) and entrained solid particulates of the flue gases, and a second heat exchanger connected to the recirculating liquid and the feedwater flowing to the first exchanger system to maintain the temperature of the recirculating scrubbing liquid below the water dew point temperature of the incoming flue gases, whereby the temperature of the flue gases discharged from the convection section are maintained constant until the convection section fouls to the degree at which its effectivenes reduces to the level at which the temperature of the flue gases cannot be maintained at the predetermined value while the heat of the flue gases to the wet scrubber is salvaged as sensible heat from the recirculated scrubbing liquid into the feedwater through the second heat exchanger.

* * * * *

UNITED STATES PATENT OFFICE
CERTIFICATE OF CORRECTION

PATENT NO. : 4,489,679

DATED : December 25, 1984

INVENTOR(S) : FLETCHER O. HOLT

It is certified that error appears in the above-identified patent and that said Letters Patent are hereby corrected as shown below:

Column 5, line 5, delete "at" and substitute --as--; line 46, delete "as" and substitute --be--; and line 50, delete "a" and substitute --the--. Column 6, line 54, delete "to" and substitute --of--. Column 7, line 45, delete "this" and substitute --thus--.

Signed and Sealed this

*Twenty-first* Day of *May 1985*

[SEAL]

*Attest:*

DONALD J. QUIGG

*Attesting Officer* *Acting Commissioner of Patents and Trademarks*